US009933214B2

(12) United States Patent
Ito

(10) Patent No.: US 9,933,214 B2
(45) Date of Patent: Apr. 3, 2018

(54) PLATE HEAT EXCHANGER AND REFRIGERATION CYCLE APPARATUS INCLUDING THE SAME

(75) Inventor: Daisuke Ito, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 856 days.

(21) Appl. No.: 14/358,392

(22) PCT Filed: Nov. 30, 2011

(86) PCT No.: PCT/JP2011/006690
§ 371 (c)(1),
(2), (4) Date: May 15, 2014

(87) PCT Pub. No.: WO2013/080256
PCT Pub. Date: Jun. 6, 2013

(65) Prior Publication Data
US 2015/0041110 A1 Feb. 12, 2015

(51) Int. Cl.
*F28F 3/08* (2006.01)
*F28F 3/04* (2006.01)
(Continued)

(52) U.S. Cl.
CPC ..... *F28F 3/046* (2013.01); *F28D 9/005* (2013.01); *F28D 2021/0068* (2013.01); *F28F 3/086* (2013.01); *F28F 2275/04* (2013.01)

(58) Field of Classification Search
CPC ..... F28D 9/0025; F28D 9/0031; F28D 9/005; F28F 3/025; F28F 3/046; F28F 3/08; F28F 3/086; B23K 1/0012; B21D 53/02
(Continued)

(56) References Cited

U.S. PATENT DOCUMENTS 1,726,458 A * 8/1929 Tellander ..... F28D 1/0333 165/170
4,237,970 A * 12/1980 Uehara ..... F28F 3/046 165/167
(Continued)

FOREIGN PATENT DOCUMENTS

JP H09-511565 A 11/1997
JP 2001-056192 A 2/2001
(Continued)

OTHER PUBLICATIONS

Office Action dated Mar. 17, 2015 issued in corresponding JP patent application No. 2013-546839 (and English translation).
(Continued)

*Primary Examiner* — Leonard R Leo
(74) *Attorney, Agent, or Firm* — Posz Law Group, PLC

(57) ABSTRACT

A plate heat exchanger reduces the cross-sectional diameter of channels and suppresses clogging of the channels with a brazing material. First heat transfer plates each include a plurality of rows of inverse V-shaped waves formed on its surface, and second heat transfer plates each include a plurality of rows of V-shaped waves formed on its surface are alternately stacked. The intersections of the waves are joined by brazing. Further, a distance (L) between joint points in the short-axis direction of the heat transfer plates and a fillet dimension (f) in the short-axis direction of the heat transfer plates satisfy a relation $0 \leq ((L-f)/L) \times 100 \leq 40$.

3 Claims, 5 Drawing Sheets

(51) Int. Cl.
*F28D 9/00* (2006.01)
*F28D 21/00* (2006.01)

(58) Field of Classification Search
USPC ..... 165/166, 167; 29/890.054
See application file for complete search history.

(56) References Cited

U.S. PATENT DOCUMENTS

| | | | | |
|---|---|---|---|---|
| 4,449,573 | A * | 5/1984 | Pettersson | F28D 17/02 165/10 |
| 4,732,713 | A * | 3/1988 | Korsell | F28F 25/087 165/166 |
| 5,806,584 | A | 9/1998 | Thonon et al. | |
| 8,596,343 | B2 | 12/2013 | Christensen et al. | |
| 2008/0087411 | A1 | 4/2008 | Richter | |
| 2011/0036549 | A1 | 2/2011 | Christensen et al. | |
| 2011/0209861 | A1 | 9/2011 | Hayashi et al. | |

FOREIGN PATENT DOCUMENTS

| | | | |
|---|---|---|---|
| JP | 2007-010225 | A | 1/2007 |
| JP | 2008-527304 | A | 7/2008 |
| JP | 2010-078286 | A | 4/2010 |
| JP | 2010117101 | A * | 5/2010 |
| JP | 2011-516815 | A | 5/2011 |
| JP | 2011-517764 | A | 6/2011 |
| JP | 2011-174689 | A | 9/2011 |
| JP | 2011-226676 | A | 11/2011 |

OTHER PUBLICATIONS

International Search Report of the International Searching Authority dated Feb. 21, 2012 for the corresponding international application No. PCT/JP2011/006690 (and English translation).
Office Action dated Jun. 30, 2017 issued in corresponding GB patent application No. GB1407312.6.
Office Action dated Oct. 12, 2017 issued in corresponding GB patent application No. GB1407312.6.

* cited by examiner (a)

(b)

PLATE HEAT EXCHANGER AND REFRIGERATION CYCLE APPARATUS INCLUDING THE SAME

CROSS REFERENCE TO RELATED APPLICATION

This application is a U.S. national stage application of PCT/JP2011/006690 filed on Nov. 30, 2011, the contents of which are incorporated herein by reference.

TECHNICAL FIELD

The present invention relates to a plate heat exchanger and a refrigeration cycle apparatus including the same.

BACKGROUND

A so-called brazed plate heat exchanger is a multilayer heat exchanger in which a plurality of heat transfer plates are stacked while being clamped between end plates provided on two sides and are joined into one plate by brazing. Adjacent heat transfer plates each have rows of channel forming patterns of projections and recesses formed on their continuous surfaces. Peaks of crests and troughs of the channel forming patterns on the adjacent heat transfer plates abut against each other to form interspaces serving as channels for fluid. Moreover, the abutting support points are joined and fixed by brazing. Each of the end plates has an inlet port and an outlet port for fluid serving as a heat transfer medium, and the heat transfer medium flows through the interspaces to exchange heat.

As the above-described channel forming patterns, a combination of adjacent V-shaped waves and inverse V-shaped waves is known as an example (see, for example, Patent Literature 1). A pattern formed by continuous waves orthogonal to each other is known as another example (see, for example, Patent Literature 2).

In a plate heat exchanger disclosed in Patent Literature 1, waves that form channels have a wave angle θ (inclination angle) of 20° to 70° (preferably 45°), a wave height h of 1 mm or less, and a wave pitch of 4 mm or less.

In Patent Literature 2, a hydraulic diameter Dh (=2×h) is 1 to 3 mm, and a wave height h is 0.5 to 1.5 mm.

PATENT LITERATURE

Patent Literature 1: Japanese Unexamined Patent Application Publication (Translation of PCT Application) No. 2011-516815

Patent Literature 2: Japanese Unexamined Patent Application Publication No. 2001-056192

The wave height h or the hydraulic diameter Dh serving as one factor for specifying the cross-sectional shape of the channels has an influence on the flow velocity of fluid. The wave angle θ is also relevant to the flow velocity.

Particularly when the wave height h is set at 1 mm or less or 0.5 to 1.5 mm, the flow velocity increases and the pressure loss becomes too high, as in Patent Literature 1 or Patent Literature 2. Hence, it is necessary to reduce the pressure loss. For this reason, to reduce the pressure loss, the flow velocity is decreased by increasing the number of plates, or the channel resistance is reduced by decreasing the wave angle θ.

However, when the number of plates increases, the weight of the heat exchanger increases, and this makes the heat exchanger expensive. When the wave angle θ is simply decreased (to, for example, 50° or less), the number of joint points between adjacent heat transfer plates increases, and this causes an increase in pressure loss of the fluid and clogging of the channels. In addition, even when the wave pitch Λ is decreased (to, for example, 4 mm or less), the distance between adjacent joint points decreases. Hence, the channels are clogged with a brazing material, and an increase in pressure loss and clogging of the channels are caused. Since the increase in pressure loss generates a nonuniform flow velocity distribution in the heat transfer plates, a drift of the fluid flow decreases the effective heat transfer area and causes breakage due to freezing. Further, the increase in pressure loss increases the power consumption of a heat pump system including the plate heat exchanger, limits the type of fluid to be used, and poses other problems.

SUMMARY

The present invention has been made to solve the above problems, and has as its object to provide a plate heat exchanger that can have channels with a small cross-sectional diameter and can restrict clogging of the channels with a brazing material, and a refrigeration cycle apparatus including the heat exchanger.

A plate heat exchanger according to the present invention is configured such that heat transfer plates each having a plurality of rows of wavy channel forming patterns formed on a surface thereof and heat transfer plates each having wavy patterns obtained by inverting the channel forming patterns are alternately stacked, and intersections of the channel forming patterns are joined.

The intersections of the channel forming patterns are joined by brazing, and a distance (L) between joint points in a short-axis direction of the heat transfer plates and a fillet dimension (f) in the short-axis direction of the heat transfer plates satisfy a relation $0 \leq ((L-f)/L) \times 100 \leq 40$.

In the plate heat exchanger of the present invention, the intersections of the channel forming patterns are joined by brazing, and the distance (L) between the joint points in the short-axis direction of the heat transfer plates and the fillet dimension (f) in the short-axis direction of the heat transfer plates satisfy a relation $0 \leq ((L-f)/L) \times 100 \leq 40$. Hence, the cross-sectional area of channels can be decreased (the cross-sectional diameter of the channels can be reduced), and clogging of the channels with a brazing material can be suppressed. Moreover, since the number of fillets can be reduced, an increase in pressure loss can be suppressed.

DETAILED DESCRIPTION

Embodiments of a plate heat exchanger according to the present invention will be described below with reference to the accompanying drawings.

Embodiment 1

Figure 1:
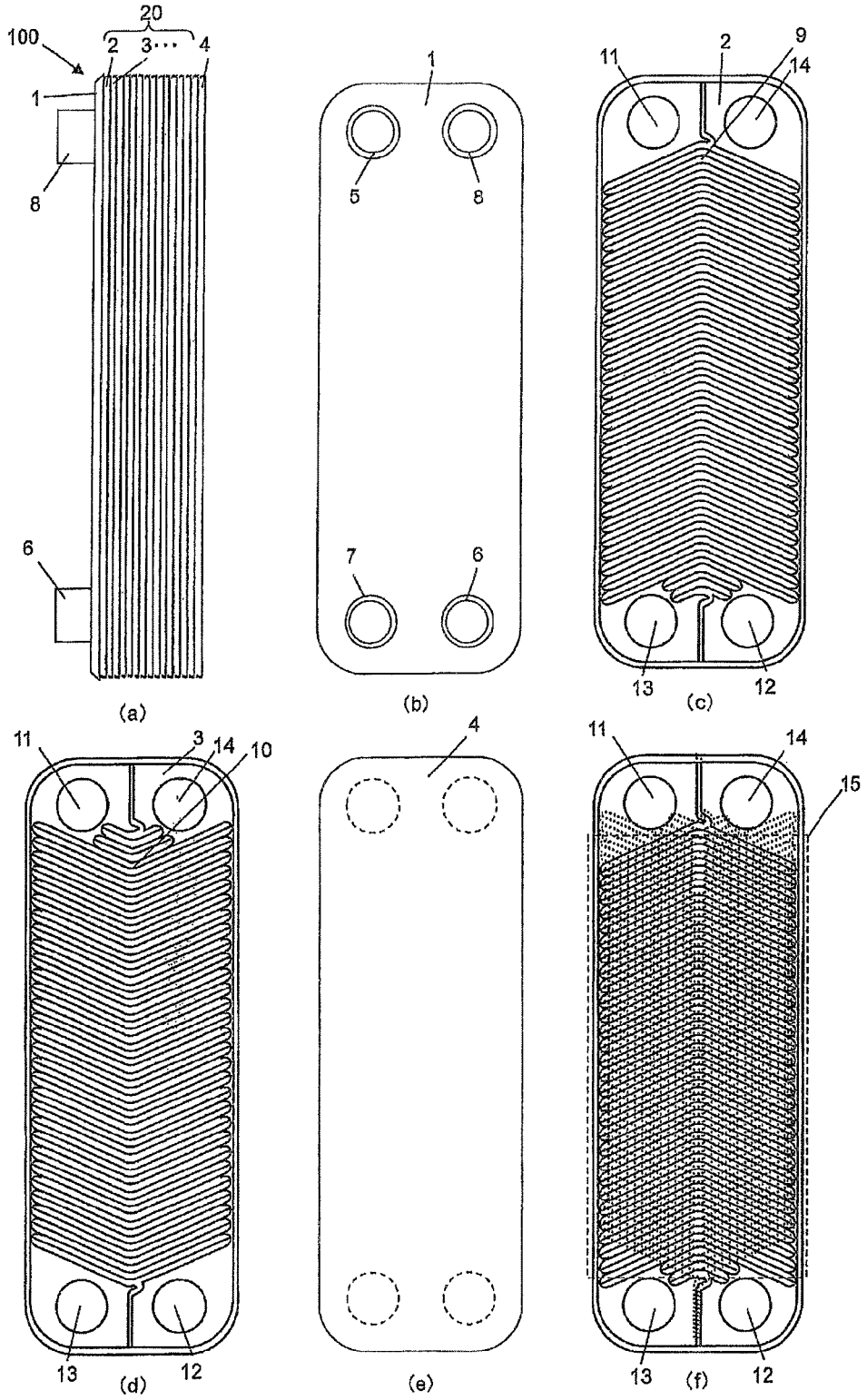
FIG. 1 includes schematic structural views of a plate heat exchanger according to Embodiment 1 of the present invention.

FIG. 1 includes schematic structural views of a plate heat exchanger 100 according to Embodiment 1 of the present invention. More specifically, FIG. 1(*a*) is a side view of the plate heat exchanger 100, FIG. 1(*b*) is a front view of an end plate 1, FIG. 1(*c*) is a front view of a heat transfer plate 2, FIG. 1(*d*) is a front view of an adjacent heat transfer plate 3, FIG. 1(*e*) is a rear view of the other end plate 4, and FIG. 1(*f*) is a front view of the heat transfer plates 2 and 3 superposed on each other.

As illustrated in FIG. 1, in this plate heat exchanger 100, heat transfer plates 2 and heat transfer plates 3 are alternately superposed and stacked, an end plate 1 and another end plate 4 are disposed on one side and the other side, respectively, of this stack (stack of heat transfer plates) 20, and these plates 1, 2, 3, and 4 are joined into one plate by brazing.

A plurality of rows of inverse V-shaped waves 9 are formed on the surface of each heat transfer plate 2 as channel forming patterns in the longitudinal direction (the up-down direction of FIG. 1). The inverse V-shaped waves 9 are arranged symmetrically with respect to a center line in the longitudinal direction.

On a surface of each of the heat transfer plates 3, a plurality of rows of V-shaped waves 10 are provided as channel forming patterns in the longitudinal direction (the up-down direction of FIG. 1). The V-shaped waves 10 are also arranged symmetrically about the center line in the longitudinal direction. The heat transfer plates 3 are obtained by inverting the heat transfer plate 2.

The stack of heat transfer plates 20 is formed by alternately superposing and stacking the heat transfer plates 2 and the heat transfer plates 3. When points where the inverse V-shaped waves 9 and the V-shaped waves 10 intersect with each other are joined by brazing, a heat-exchange fluid flows through interspaces formed between adjacent joint points. Also, channel forming patterns are formed in a rectangular area indicated by a dashed frame illustrated in FIG. 1(*f*), and serve as a heat transfer surface (heat transfer area) 15 for heat exchange. The channel forming patterns are formed by, for example, press working or etching.

The end plate 1 serves as a reinforcing plate, and is also called a side plate. The end plate 1 has, at the four corners of a rectangle, an inlet pipe 5 for a first fluid, an outlet pipe 7 for the first fluid, an inlet pipe 6 for a second fluid, and an outlet pipe 8 for the second fluid, respectively. Also, the heat transfer plates 2 and 3 each have a communication hole 11 communicating with the inlet pipe 5 for the first fluid, a communication hole 13 communicating with the outlet pipe 7 for the first fluid, a communication hole 12 communicating with the inlet pipe 6 for the second fluid, and a communication hole 14 communicating with the outlet pipe 8 for the second fluid.

The end plate 4 serves as a reinforcing plate as well, and is also called a side plate. The end plate 4 serves to turn one of the fluids, for example, the first fluid back from an inlet side to an outlet side.

Both of the end plates 1 and 4 reinforce the plate heat exchanger 100, and this improves the pressure resistance.

While the planar shape of the above-described plates 1 to 4 is a rectangular shape in the following description, it is not limited to a rectangular shape, and may be, for example, a square shape. The plates 1 to 4 are each formed by a metal plate. In particular, the material of the heat transfer plates 2 and 3 is selected in consideration of the properties such as mechanical strength, thermal conductivity, and percentage of elongation. Suitable examples of such a material include aluminum, stainless steel, and copper.

Figure 2:
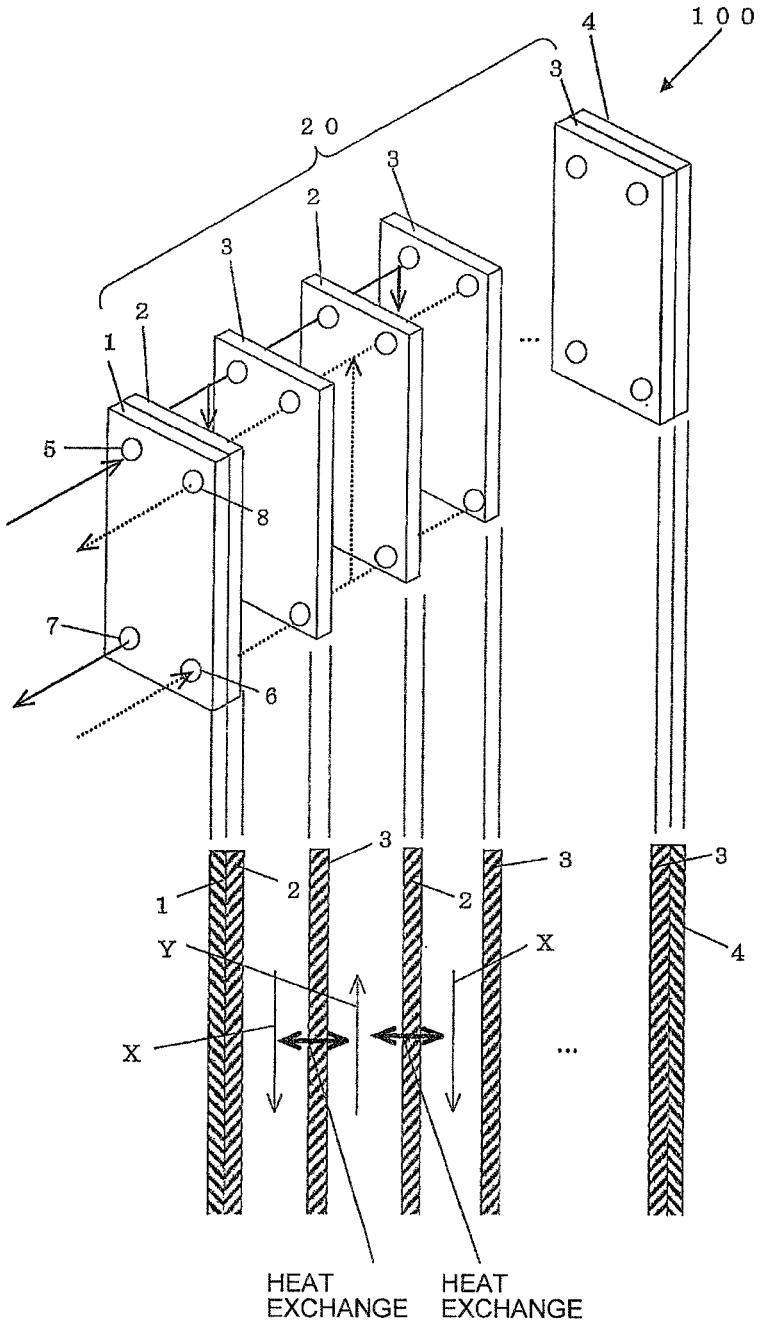
FIG. 2 is a schematic view illustrating currents of fluid in the plate heat exchanger of FIG. 1.

FIG. 2 schematically illustrates currents of fluid in the plate heat exchanger 100. A solid arrow represents a current X of the first fluid, and a dashed arrow represents a current Y of the second fluid. Referring to FIG. 2, the stack of heat transfer plates 20 is illustrated in a divided state for the sake of easy understanding of the currents of two kinds of fluids.

As illustrated in FIG. 2, in the plate heat exchanger 100, each of the current X of the first fluid and the current Y of the second fluid is formed on every other heat transfer plate of heat transfer plates 2 or 3 as, for example, a corresponding one of upward and downward countercurrents so that the first fluid and the second fluid do not mix with each other.

Figure 3:
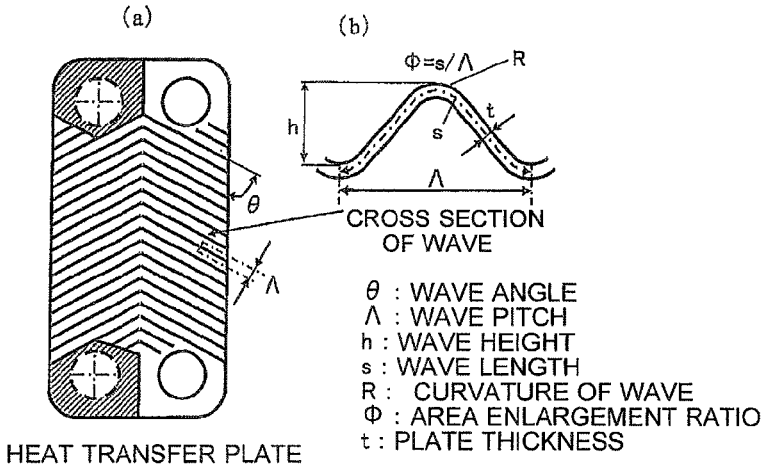
FIG. 3 includes explanatory views showing definitions of variables such as a wave angle θ, a wave pitch Λ, and a wave height h.

FIG. 3 includes explanatory views showing definitions of variables such as a wave angle θ, a wave pitch Λ, and a wave height h. FIG. 3 shows the case of the heat transfer plate 2 as an example. FIG. 3(*a*) is a plan view of the heat transfer plate 2, and FIG. 3(*b*) is an enlarged sectional view illustrating a waveform in a direction perpendicular to a waveform of FIG. 3(*a*).

Definitions of the variables in FIG. 3 will be given hereinafter. The curvature of the wave illustrated in FIG. 3(*b*) is represented as R.

A wave angle θ is the inclination angle with respect to the center line of the inverse V-shaped waves 9 (or V-shaped waves 10) in the direction in which these waves are aligned.

A wave pitch Λ is the distance between peaks of troughs (or crests) of adjacent waves in a direction perpendicular to the center lines of the waves 9 extending in the direction of the wave angle θ.

A wave height h is the distance between the crest and the trough of each wave.

A wave length s is the length of the center line of a plate thickness t of the wave.

Further, an area enlargement ratio Φ is defined as s/A.

Figure 4:
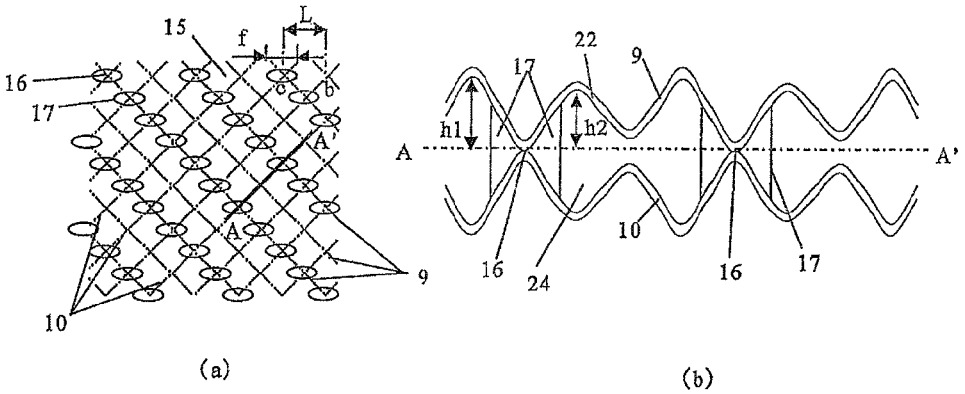
FIG. 4(*a*) illustrates the positions of joint points, a fillet dimension f in the plate short-axis direction, and a distance L between adjacent joint points in the plate short-axis direction in Embodiment 1, and FIG. 4(*b*) is an enlarged sectional view taken along a line A-A' of FIG. 4(*a*).

FIG. 4(*a*) illustrates the positions of joint points 16, a dimension f of fillets 17 in the short-axis direction, and a distance L between adjacent joint points 16 in the plate short-axis direction in Embodiment 1 of the present invention. FIG. 4(*b*) is an enlarged sectional view taken along a line A-A' of FIG. 4(*a*).

Note that in Embodiment 1, the plate short-axis direction refers to the direction of short sides of the heat transfer plates 2 and 3.

As illustrated in FIG. 4(*a*), points (joint points) 16 where the inverse V-shaped waves 9 of the heat transfer plate 2 and the V-shaped waves 10 of the heat transfer plate 3 intersect with each other are joined by brazing.

At this time, in Embodiment 1, as can be seen from FIGS. 4(*a*) and 4(*b*), at least one non-joint wave 22 is provided between adjacent joint points 16 of waves continuing in the direction perpendicular to the center lines of the waves 9 extending in the direction of the wave angle θ. That is, the joint points 16 are formed at every other intersection of the channel forming patterns in the plate short-axis direction. A wave height h2 of the non-joint wave 22 is set less than a wave height h1 at the joint points 16 (h2<h1). The first fluid and the second fluid described above flow through channels 24 thus formed between the fillets 17.

In Embodiment 1, as described above, at least one non-joint wave 22 is provided between adjacent joint points 16 of the waves continuing in the direction perpendicular to the center lines of the waves 9 extending in the direction of the wave angle θ. Thus, letting L be the distance between joint points 16 (*b*-*c*) in the plate short-axis direction, and f be the dimension of the fillets 17 in the plate short-axis direction, even when the distance L between the joint points 16 in the plate short-axis direction is so short as to have, for example, a relation $0 \leq ((L-f)/L) \times 100 \leq 40$, the cross-sectional area of the channels 24 can be reduced (the cross-sectional diameter of the channels can be reduced), and clogging of the channels 24 with the brazing material can be prevented. Therefore, it is possible to lessen reduction of the effective heat transfer area and freezing due to a nonuniform velocity distribution generated in the heat transfer plates 2 and 3. Further, the number of joint points can be reduced, and this can reduce the amount of brazing material used. Hence, it is possible to reduce the cost and weight of the heat exchanger.

While two types of wave heights have been described with reference to FIG. 4, a plurality of wave heights may be adopted, and the number of joint points may be adjusted in accordance with the type of fluid or the flow velocity distribution. Alternatively, the wave height h2 of the non-joint wave 22 may be set equal to the wave height h1 of a joint wave at the joint point 16 or more than the wave height h1 (h2>h1).

The channel forming patterns are not limited to V-shaped waves, and may be mountain-shaped, arcuate, or sawtoothed waves.

Embodiment 2

Figure 5:
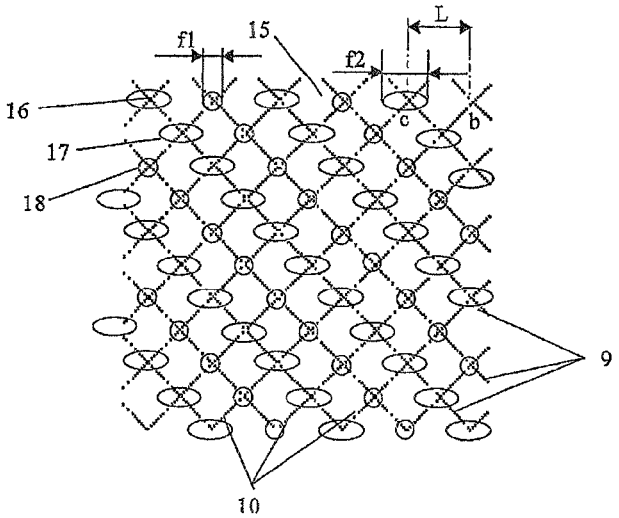
FIG. 5 illustrates the positions of joint points, a fillet dimension f in the plate short-axis direction, and a distance L between adjacent joint points in the plate short-axis direction in Embodiment 2 of the present invention.

FIG. 5 illustrates the positions of joint points, a fillet dimension f in the short-axis direction, and a distance L between adjacent joint points in the short-axis direction in Embodiment 2 of the present invention. A plate heat exchanger (not illustrated) of Embodiment 2 has a structure similar to that of the plate heat exchanger 100 illustrated in FIGS. 1 and 2.

While at least one non-joint wave 22 is provided between adjacent joint points 16 of the waves continuing in the direction perpendicular to the center lines of the waves 9 extending in the direction of the wave angle θ in Embodiment 1 described above, fillets 17 at adjacent joint points 16 of waves continuing in the direction perpendicular to the center lines of waves 9 extending in the direction of the wave angle θ are formed with different fillet dimensions f in Embodiment 2.

That is, in Embodiment 2, as illustrated in FIG. 5, fillet dimensions f1 and f2 are formed at joints points 16 that are adjacent to each other in the plate short-axis direction such that the fillet dimension f1 is set smaller than the fillet dimension f2 (f1<f2). This can prevent channels 24 from being clogged with a brazing material even when the distance L between the joint points 16 that are adjacent to each other in the plate short-axis direction and the fillet dimension f in the plate short-axis direction are so short as to satisfy a relation $0 \leq ((L-f)/L) \times 100 \leq 40$. Therefore, an advantage substantially similar to that of Embodiment 1 is obtained.

As a method for decreasing the fillet dimension f, the brazing material used for joint points 16 of adjacent heat transfer plates 2 and 3 is replaced with a locally thin material, or the amount of brazing material itself is reduced. The fillet dimension f can be decreased by bringing the adjacent heat transfer plates 2 and 3 into point contact with each other, and the fillet dimension f is increased by bringing the heat transfer plates 2 and 3 into surface contact with each other. Further, the fillet dimension f is decreased by decreasing a curvature dimension R of crests or troughs of the waves (see FIG. 3). For example, when the curvature dimension R of the crests or troughs of the waves is decreased for each of waves continuing in the direction perpendicular to the center lines of the waves 9 extending in the direction of the wave angle θ, a distribution of the fillet dimensions f1 and f2 as illustrated in FIG. 5 can be formed.

While two fillet dimensions f are specified in FIG. 5, a plurality of fillet dimensions f may be specified, and the fillet dimension f may be adjusted in accordance with the type of fluid or the flow velocity distribution. When the fillet dimension f is partly decreased, not only clogging of the channels 24 can be prevented, but also the pressure loss can be reduced because the resistance applied to the fluid decreases. For this reason, a refrigerant with a low working pressure (for example, hydrocarbon or low-GWP refrigerant) can be used. Further, when fillets are completely omitted albeit locally on a heat transfer surface 15, the joint strength of the heat transfer surface 15 decreases. Hence, a remarkable decrease in strength of the heat transfer surface 15 can be prevented by forming the small fillets 18 as in Embodiment 2.

Embodiment 3

Figure 6:
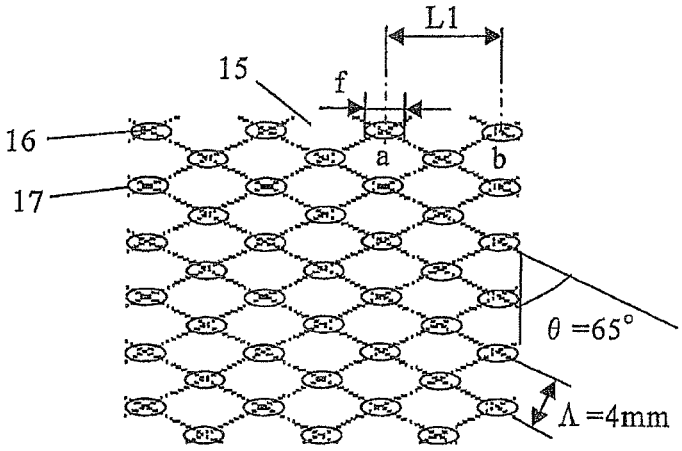
FIG. 6 includes views illustrating a distance L between joint points in the plate short-axis direction when a wave angle θ and a wave pitch Λ are changed in Embodiment 3 of the present invention.
Figure 6:
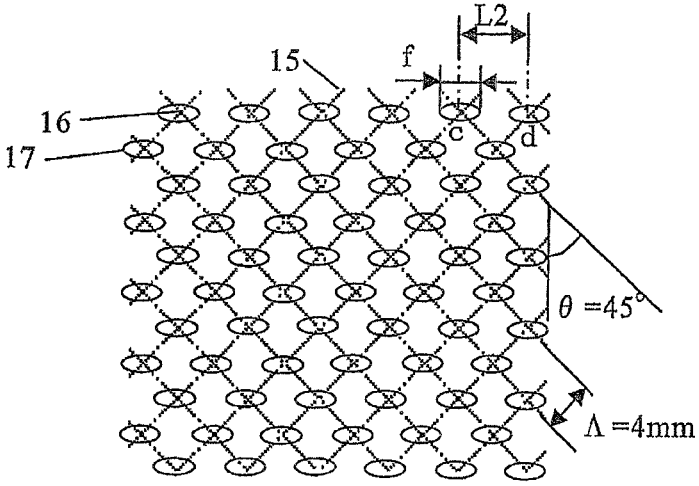

FIG. 6 illustrates a distance L between joint points in the plate short-axis direction when a wave angle θ and a wave pitch Λ are changed in Embodiment 3 of the present invention. FIG. 6(*a*) illustrates a case in which the wave angle θ is 65° and the wave pitch Λ is 4 mm, and FIG. 6(*b*) illustrates a case in which the wave angle θ is 45° and the wave pitch Λ is 4 mm. However, the wave pitch Λ is fixed in Embodiment 3. A plate heat exchanger (not illustrated) of Embodiment 3 has a structure similar to that of the plate heat exchanger 100 illustrated in FIGS. 1 and 2.

While different fillet dimensions f are specified in Embodiment 2 above, a wave height h is 0.8 to 1.4 mm and a wave angle θ is 40° to 50° in Embodiment 3.

Since the wave height h is set as low as 0.8 to 1.4 mm in Embodiment 3, if the wave angle θ exceeds 50°, the pressure loss becomes too high, and the flow velocity needs to be decreased by increasing the number of plates to increase the cross-sectional area of channels. Hence, the weight of the heat exchanger cannot be reduced. For this reason, the pressure loss is reduced by decreasing the wave angle θ. For example, the wave angle θ is set small, as illustrated in FIG. 6.

When the wave angle θ is decreased, for example, from 65° to 45°, the distance L between the joint points 16 in the plate short-axis direction satisfies L1>L2, as illustrated in FIG. 6(*b*). When the wave angle θ is 45°, and the wave pitch Λ is less than 4 mm, fillets 17 made of a brazing material formed at joint points c and d are combined and the channels are thereby clogged.

Figure 7:
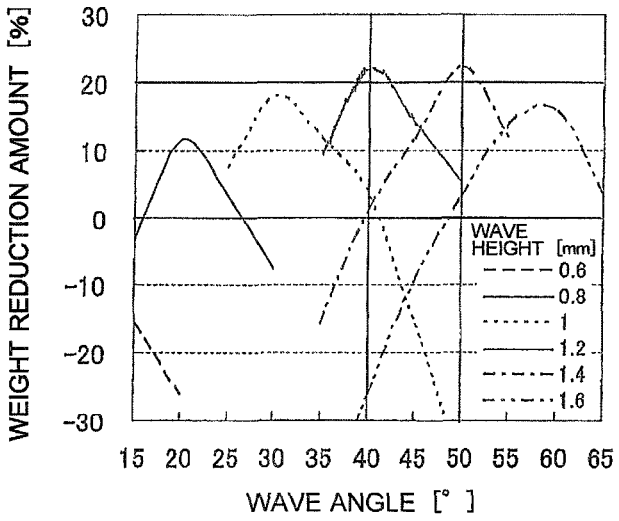
FIG. 7 is a graph showing the relationship between the wave angle θ and the amount of weight reduction of the plate heat exchanger.

FIG. 7 is a graph showing the relationship between the wave angle θ and the amount of weight reduction of the plate heat exchanger. As can be seen from FIG. 7, to reduce the weight of the heat exchanger, a great weight reduction effect can be obtained when the wave angle θ falls within the range of 40° to 50° (especially 45°) for a wave height h that falls within the range of 0.8 to 1.4 mm. Therefore, it is preferable to form a heat transfer surface 15 such that the wave angle θ falls within the range of 40° to 50°. However, if the wave pitch Λ is 4 mm or less, the distance L between adjacent joint points 16 in the plate short-axis direction and the fillet dimension f in the plate short-axis direction satisfy a relation $0 \leq ((L-f)/L) \times 100 \leq 40$, and the channels are clogged with the brazing material. For this reason, practicing Embodiments 1 and 2 in combination makes it possible to form the heat transfer surface 15 free from clogging of the channels with the brazing material even when the distance L between adjacent joint points 16 in the plate short-axis direction and the fillet dimension f in the plate short-axis direction satisfy a relation $0 \leq ((L-f)/L) \times 100 \leq 40$. Thus, in Embodiment 3, the weight of the plate heat exchanger can be greatly reduced, in addition to weight reduction of the heat exchanger by reducing the amount of brazing material used in Embodiments 1 and 2.

Embodiment 4

In Embodiment 4, a refrigeration cycle apparatus including the plate heat exchanger 100 described in Embodiments 1 to 3 above will be described.

The plate heat exchanger 100 is utilized in refrigeration cycle apparatuses mounted in apparatuses for, for example, air conditioning, hot-water supply, floor heating, electric power generation, and heat sterilization of food.

Figure 8:
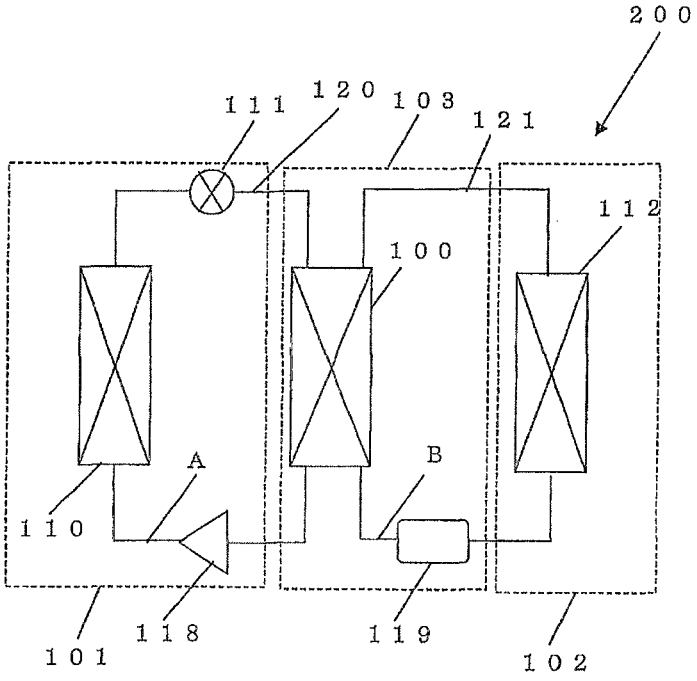
FIG. 8 is a circuit diagram of a refrigeration cycle apparatus according to Embodiment 4 of the present invention.

FIG. 8 is a circuit diagram of a refrigeration cycle apparatus (air-conditioning apparatus) according to Embodiment 4 of the present invention.

An air-conditioning apparatus 200 according to Embodiment 4 includes one outdoor unit 101 serving as a heat source unit, one indoor unit 102, and a heat medium relay unit 103 that transfers cooling energy of a heat-source-side refrigerant flowing through the outdoor unit 101 to a heat medium flowing through the indoor unit 102.

The outdoor unit 101 and the heat medium relay unit 103 are connected by a refrigerant pipe 120, which conducts a heat-source-side refrigerant (first fluid), to constitute a refrigerant circuit A. The heat medium relay unit 103 and the indoor unit 102 are connected by a heat medium pipe 121, which conducts a heat medium (second fluid), to constitute a heat medium circuit B.

At least a heat-source-side heat exchanger 110, a compressor 118, and an expansion unit 111 are mounted in the outdoor unit 101.

At least a use-side heat exchanger 112 is mounted in the indoor unit 102.

At least the plate heat exchanger 100 according to Embodiment 1 and a pump 119 are mounted in the heat medium relay unit 103.

While an example in which the plate heat exchanger 100 is mounted in the heat medium relay unit 103 will be given, the plate heat exchanger 100 need only be adopted as a heat exchanger in at least one of the outdoor unit 101, the indoor unit 102, and the heat medium relay unit 103.

While the air-conditioning apparatus 200 for performing cooling operation will be described as an example of a refrigeration cycle apparatus in Embodiment 4, heating operation can also be performed with, for example, a four-way valve being added in the refrigerant circuit A, as a matter of course.

The heat-source-side heat exchanger 110 functions as a condenser, and exchanges heat between the heat-source-side refrigerant flowing through the refrigerant pipe 120 and the outdoor air. The heat-source-side heat exchanger 110 is connected on its one side to the plate heat exchanger 100, and is connected on its other side to the discharge side of the compressor 118.

The compressor 118 compresses and conveys the heat-source-side refrigerant to the refrigerant circuit A. The compressor 118 is connected on its discharge side to the heat-source-side heat exchanger 110, and is connected on its suction side to the plate heat exchanger 100.

The expansion unit 111 decompresses and expands the heat-source-side refrigerant flowing through the refrigerant pipe 120. The expansion unit 111 is connected on its one side to the heat-source-side heat exchanger 110 and is connected on its other side to the plate heat exchanger 100. It is desired to form the expansion unit 111 by, for example, a capillary or a solenoid valve.

The use-side heat exchanger 112 exchanges heat between the heat medium flowing through the heat medium pipe 121 and the air in an air-conditioned space. The use-side heat exchanger 112 is connected on its one side to the plate heat exchanger 100 and is connected on its other side to the suction side of the pump 119.

The plate heat exchanger 100 exchanges heat between the heat-source-side refrigerant and the heat medium. The plate heat exchanger 100 is connected to the suction side of the compressor 118 and the expansion unit 111 via the refrigerant pipe 120. The plate heat exchanger 100 is also connected to the use-side heat exchanger 112 and the pump 119 via the heat medium pipe 121. That is, the plate heat exchanger 100 is cascaded to the refrigerant circuit A and the heat medium circuit B.

The pump 119 conveys the heat medium to the heat medium circuit B. The pump 119 is connected on its suction side to the use-side heat exchanger 112 and is connected on its discharge side to the plate heat exchanger 100.

Flow of the heat-source-side refrigerant in the refrigerant circuit A will be described.

A low-temperature and low-pressure heat-source-side refrigerant is compressed by the compressor 118, and is discharged as a high-temperature and high-pressure gas refrigerant. The high-temperature and high-pressure gas refrigerant discharged from the compressor 118 flows into the heat-source-side heat exchanger 110. Then, the high-temperature and high-pressure gas refrigerant turns into a high-pressure liquid refrigerant while rejecting heat to the outdoor air in the heat-source-side heat exchanger 110. The high-pressure liquid refrigerant that has flowed out of the heat-source-side heat exchanger 110 is expanded by the expansion unit 111 into a low-temperature and low-pressure two-phase refrigerant. The low-temperature and low-pressure two-phase refrigerant flows into the plate heat exchanger 100 functioning as an evaporator. Then, the low-temperature and low-pressure two-phase refrigerant turns into a low-temperature and low-pressure gas refrigerant while cooling the heat medium circulating in the heat medium circuit B by removing heat from the heat medium. The gas refrigerant that has flowed out of the plate heat exchanger 100 is sucked into the compressor 118 again.

Flow of the heat medium in the heat medium circuit B will be described next.

The heat medium pressurized by the pump 119 and flowing out therefrom flows into the plate heat exchanger 100, and cooling energy of the heat-source-side refrigerant in the plate heat exchanger 100 is transferred to the heat medium. After flowing out of the plate heat exchanger 100, this heat medium flows into the use-side heat exchanger 112. Then, the heat medium cools the air-conditioned space by removing heat from the indoor air in the use-side heat exchanger 112. The heat medium that has flowed out of the use-side heat exchanger 112 is sucked into the pump 119 again.

According to Embodiment 4, it is possible to provide the highly-reliable inexpensive air-conditioning apparatus 200 that can reduce power consumption and can reduce the amount of $CO_2$ emissions because the above-described plate heat exchanger 100 is mounted therein.

The invention claimed is:

1. A plate heat exchanger, comprising:

first heat transfer plates each having a plurality of rows of wavy first channel forming patterns formed on a first surface thereof; and second heat transfer plates each having wavy second channel forming patterns formed on a second surface thereof, the second channel forming patterns being obtained by reversing front and back sides and turning upside down the first channel forming patterns, wherein the first heat transfer plates and the second heat transfer plates are alternately stacked, and peaks of each of the first channel forming patterns and peaks of each of the second channel forming patterns abut against each other to form intersections of the first and second channel forming patterns, the intersections are joined by brazing, fillets are formed at the intersections, and comprise first fillets and second fillets that are adjacent to the first fillets, first dimensions (f1) of the first fillets in a short-axis direction of the first and second heat transfer plates are smaller than second dimensions (f2) of the second fillets in the short-axis direction of the first and second heat transfer plates ($f1<f2$), and a distance (L) between joint points in the short-axis direction of the first and second heat transfer plates and the second dimensions (f2) satisfy a relation $0\leq((L-f2)/L)\times100\leq40$, wherein the first and second fillets are formed at adjacent joint points of waves in the first and second channel forming patterns continuing in a direction parallel to lines which intersect with center lines of the waves of the first and second channel forming patterns extending in the direction of a wave angle ($\theta$).

2. The plate heat exchanger of claim 1, wherein the first and second channel forming patterns are formed by a combination of V-shaped waves and inverse V-shaped waves.

3. The plate heat exchanger of claim 1, wherein the plate heat exchanger is configured such that two kinds of fluids flowing through the plate heat exchanger are cascaded to a refrigerant circuit.

* * * * *